US008820547B2

(12) United States Patent
Hayashida et al.

(10) Patent No.: US 8,820,547 B2
(45) Date of Patent: Sep. 2, 2014

(54) MOVABLE RACK UNIT

(71) Applicant: THK Co., Ltd., Tokyo (JP)

(72) Inventors: Tetsuya Hayashida, Tokyo (JP); Eiji Hosaka, Tokyo (JP)

(73) Assignee: THK Co., Ltd., Tokyo (JP)

( * ) Notice: Subject to any disclaimer, the term of this patent is extended or adjusted under 35 U.S.C. 154(b) by 0 days.

(21) Appl. No.: 13/961,560

(22) Filed: Aug. 7, 2013

(65) Prior Publication Data

US 2014/0048504 A1 Feb. 20, 2014

(30) Foreign Application Priority Data

Aug. 20, 2012 (JP) ..... 2012-181529

(51) Int. Cl.
*A47F 7/00* (2006.01)
*A47B 96/00* (2006.01)
*A47B 61/00* (2006.01)

(52) U.S. Cl.
CPC ..... *A47B 96/00* (2013.01); *A47B 61/003* (2013.01)
USPC ..... 211/85.3; 211/162

(58) Field of Classification Search
CPC ..... A47B 61/02; A47B 61/00; A47B 61/003
USPC ..... 211/162, 1.57, 85.3, 94.01, 182; 312/132, 334.11
See application file for complete search history.

(56) References Cited

U.S. PATENT DOCUMENTS

| | | | | | |
|---|---|---|---|---|---|
| 732,670 | A * | 6/1903 | Watkins et al. | 190/13 R |
| 829,527 | A * | 8/1906 | Holmes | 312/132 |
| 1,587,675 | A * | 6/1926 | Patterson | 211/1.3 |
| RE18,267 | E * | 12/1931 | Green, Jr. | 312/300 |
| 2,388,949 | A * | 11/1945 | Bloxham | 52/27 |
| 2,967,081 | A * | 1/1961 | Kleinpenning | 312/268 |
| 4,252,242 | A * | 2/1981 | Tudor | 211/96 |
| 4,693,345 | A * | 9/1987 | Mittelmann | 190/108 |
| 6,253,472 | B1 * | 7/2001 | Gast | 38/137 |
| 6,679,392 | B1 * | 1/2004 | Costa | 211/94.01 |
| 7,946,543 | B2 * | 5/2011 | Cotter et al. | 248/159 |
| 8,511,487 | B2 * | 8/2013 | Andersen et al. | 211/144 |
| 2010/0122963 | A1 * | 5/2010 | Costa et al. | 211/94.01 |

FOREIGN PATENT DOCUMENTS

| | | | |
|---|---|---|---|
| JP | 05-3809 | A | 1/1993 |
| JP | 06-62928 | A | 3/1994 |
| JP | 07-88015 | A | 4/1995 |
| JP | 08-66250 | A | 3/1996 |
| JP | 2002-17492 | A | 1/2002 |
| JP | 2004-20263 | A | 7/2004 |

* cited by examiner

*Primary Examiner* — Korie H Chan
(74) *Attorney, Agent, or Firm* — Westerman, Hattori, Daniels & Adrian, LLP

(57) ABSTRACT

Provided is a movable rack unit for taking in and out a storage object with respect to a storage space. The movable rack unit includes a guide part including a track member linearly laid inside the storage space and along a depth direction of the storage space and a moving body that moves along the track member. A support member is rotatably borne on the moving body, and the support member supports the storage object within the storage space. Further, this unit includes a rotation guiding part, and the rotation guiding part changes the attitude of the support member in accordance with the position of the moving body with respect to the track member. When the moving member reaches an opening portion side of the storage space, the rotation guiding part rotates the support member so that merely the support member is set outside the storage space.

3 Claims, 7 Drawing Sheets

MOVABLE RACK UNIT

TECHNICAL FIELD

The present invention relates to a movable rack unit for taking in and out a storage object with respect to a storage space.

BACKGROUND ART

As one type of the above-mentioned movable rack unit, there is known a movable rack unit for storing a storage object such as a coat into a predetermined space. The movable rack unit is widely used in a house closet or in a passenger room of transportation facilities such as an aircraft and a high-speed railway.

As the movable rack unit of this type, there is known one disclosed in JP2004202063A. This movable rack unit is configured as follows. A movable body on which a storage object such as a coat is hung is assembled to a storage unit main body via a slide rail unit, and the movable body slides with respect to the storage unit main body. By pulling out the entire movable body from the storage unit main body, the storage object hung on the movable body can be taken in and out with respect to the storage unit main body.

DISCLOSURE OF THE INVENTION

Problems to be Solved by the Invention

In the case of such a movable rack unit as the one disclosed in JP2004202063A, when, of a plurality of storage objects arranged on the movable body, a storage object hung on the rear side of the movable body is taken out, it is necessary to pull out the entire movable body from the storage unit main body, and hence it has been troublesome to take out the storage object. Further, for example, when the movable rack unit is applied to a passenger room in transportation facilities such as an aircraft and a high-speed railway, there is a limitation in space for installing the movable rack unit, and it is often the case that an opening portion of the storage space faces a passage used by the crews and passengers. Under such a usage environment, when the entire movable body is pulled out from the storage unit main body, the pulled-out movable body may become a barrier for the passengers and the like passing in front of the movable rack unit, which has been a problem.

Means for Solving the Problems

The present invention has been made in view of the above-mentioned problem, and provides a movable rack unit which is applicable even when a storage object is to be pulled out into a narrow space, and is capable of easily taking in and out the storage object with respect to a storage space.

That is, the present invention relates to a movable rack unit for taking in and out a storage object with respect to a storage space. The movable rack unit includes guide means including a track member linearly laid inside the storage space and along a depth direction of the storage space and a moving body assembled to the track member so as to be movable along the track member. A support member is rotatably borne on the moving body, and the support member supports the storage object within the storage space. Further, the movable rack unit includes rotation guiding means, and the rotation guiding means changes the attitude of the support member in accordance with the position of the moving body with respect to the track member. Specifically, in a case where the moving member moves from the backside inside the storage space toward an opening portion along the track member, when the moving body is located at an end portion of the track member on the opening portion side, the rotation guiding means rotates the support member so that the support member is set outside the storage space. With this, even when a space in front of the storage space, that is, a space facing the opening portion of the storage space is narrow, the storage object may be taken in and out with respect to the storage space.

MODE FOR CARRYING OUT THE INVENTION

Now, with reference to the accompanying drawings, a movable rack unit according to an embodiment of the present invention is described in detail.

Figure 1:
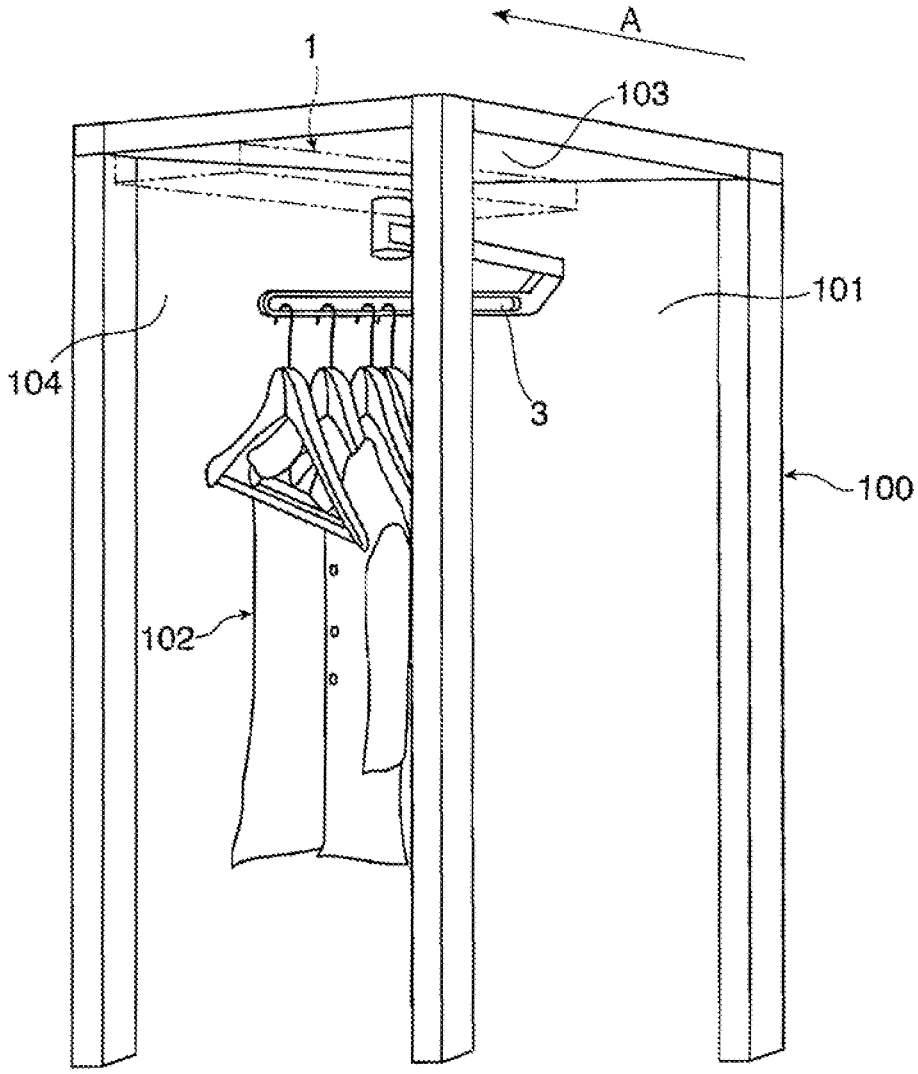
FIG. 1 is a schematic view illustrating a usage mode of a movable rack unit according to an embodiment of the present invention.
Figure 2:
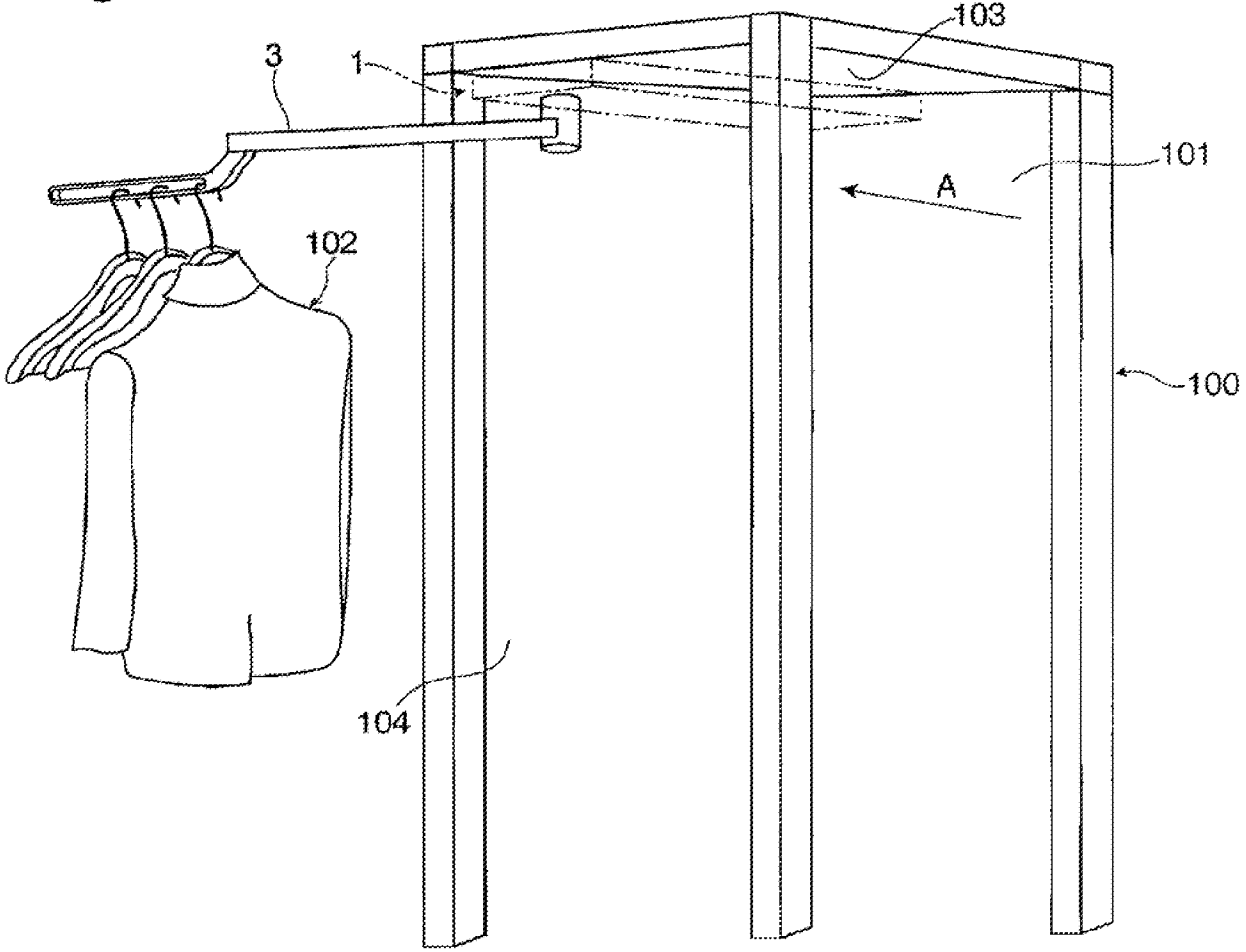
FIG. 2 is a schematic view illustrating an action state of the movable rack unit illustrated in FIG. 1.

FIGS. 1 and 2 illustrate a usage mode of the movable rack unit according to the embodiment of the present invention. FIG. 1 is a perspective view illustrating a movable rack unit 1 in a state where a storage object 102 such as a coat is stored inside a storage space 101 defined by a storage cabinet 100. FIG. 2 is a perspective view illustrating the movable rack unit 1 in a state where the storage object 102 is pulled out from the storage space 101. The movable rack unit 1 is provided on a storage top plate 103 placed across an upper portion of the storage cabinet 100. A plurality of storage objects 102, such as coats, are hung on a support arm 3 serving as a support member included in the movable rack unit 1, and are stored inside the storage space 101 under this state. In this configuration of the movable rack unit 1, the support arm 3 is movable in the depth direction (direction of an arrow A in FIGS. 1 and 2) of the storage space 101. When the support arm 3 moves from the back side of the storage space 101 to reach the position of an opening portion 104, the attitude of the support arm 3, and by extension, the attitude of the storage object 102 can be changed by about 90°, for example (see FIG. 2). Note that, in FIGS. 1 and 2, for easy understanding of the usage mode of the movable rack unit 1 inside the storage space 101, illustration of wall portions other than the opening portion 104, which define the storage space 101, is omitted.

Figure 3:
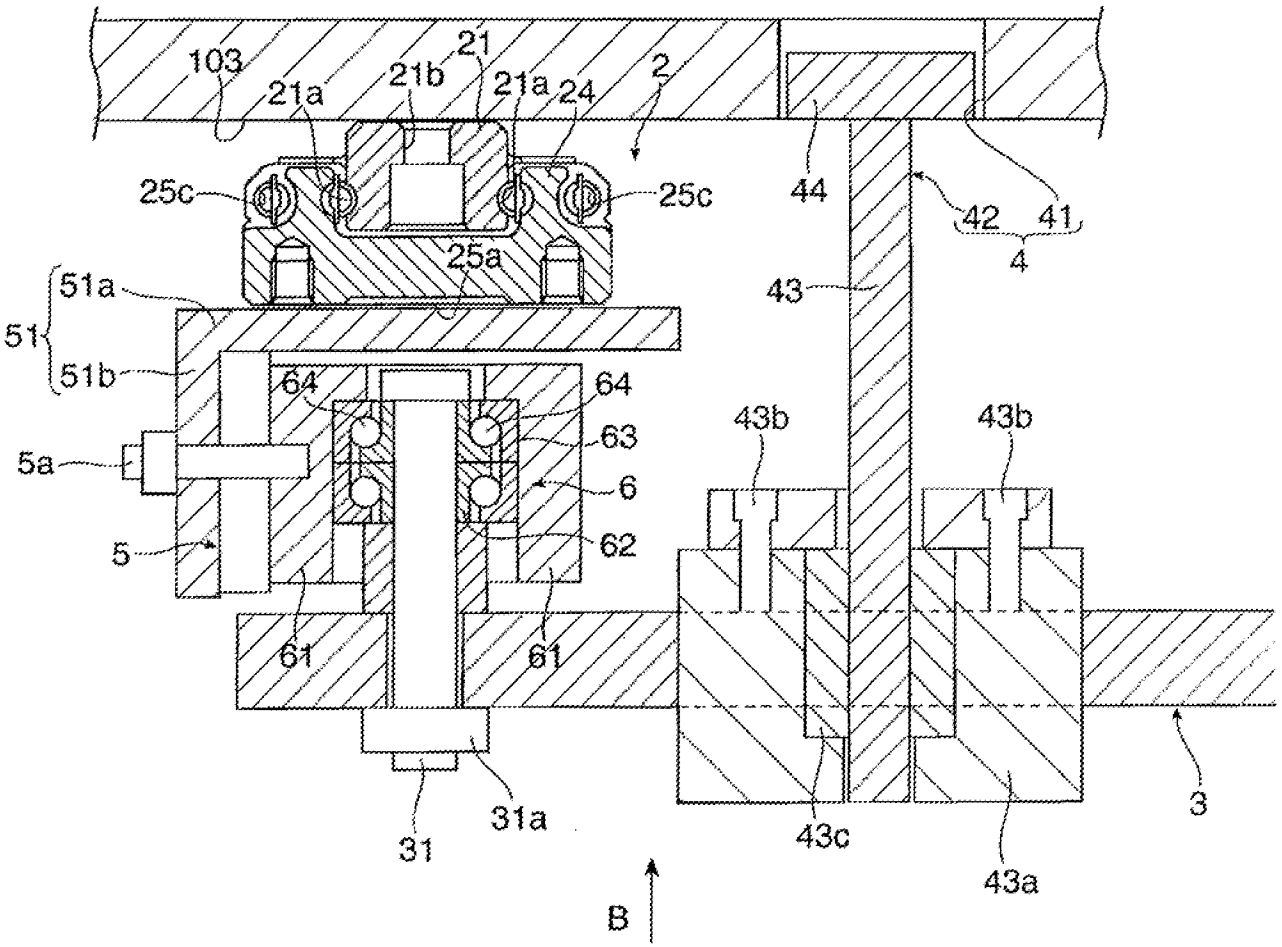
FIG. 3 is a front sectional view illustrating a main part of a movable rack unit according to one embodiment of the present invention.
Figure 4:
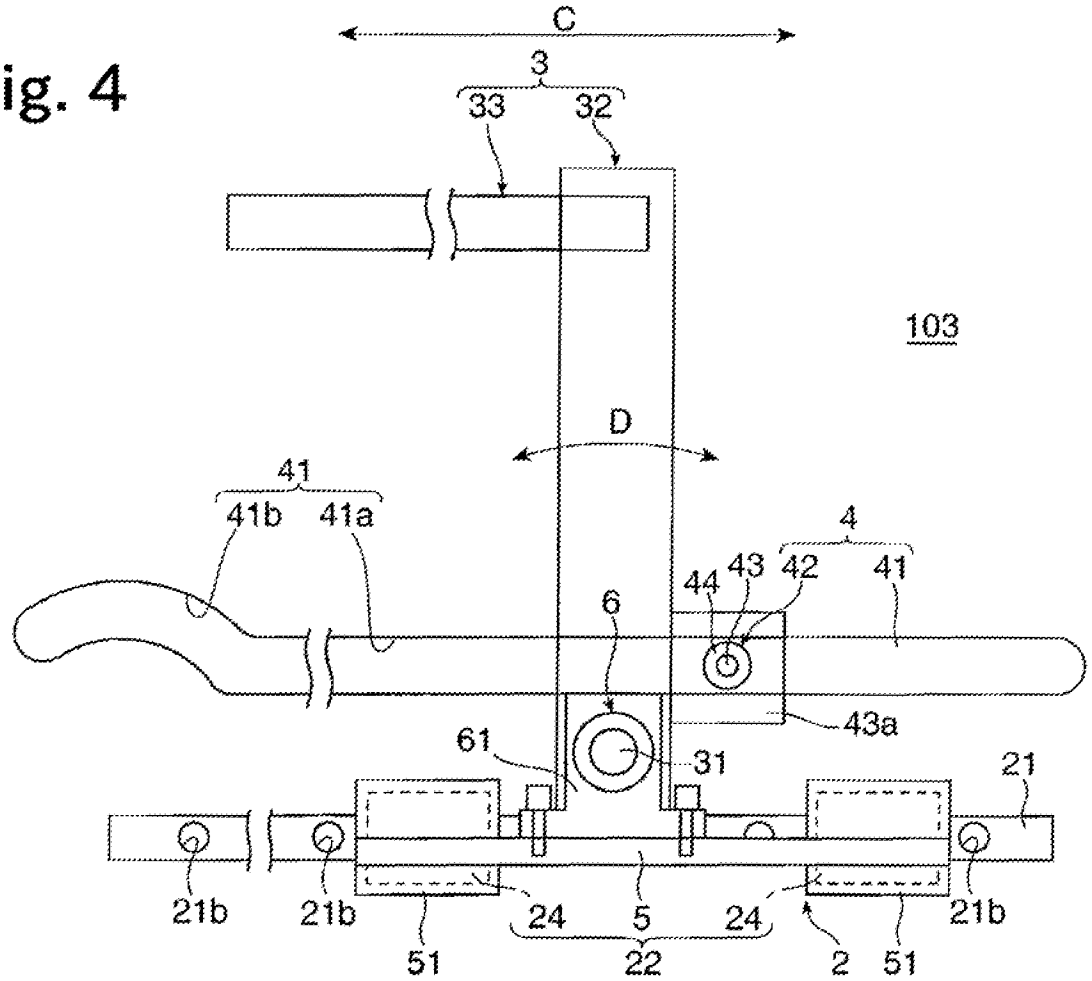
FIG. 4 is a view as seen from an arrow B illustrated in FIG. 3.

FIGS. 3 and 4 illustrate the movable rack unit 1 according to this embodiment. FIG. 3 is a front sectional view illustrating the main part of the movable rack unit 1. On the other hand, FIG. 4 is a view as seen from an arrow B illustrated in FIG. 3, in which the storage top plate 103 is observed from the inside of the storage space 101. The movable rack unit 1 according to this embodiment includes a linear guide device 2 serving as guide means for guiding the support arm 3 in a direction from the back side of the storage space 101 toward the opening portion 104 (direction of an arrow C in FIG. 4), the support arm 3 on which the plurality of storage objects 102 are to be hung, and rotation guiding means 4 for changing the attitude of the storage object 102 at the opening portion 104 of the storage space 101. Note that, the direction of the arrow C illustrated in FIG. 4 matches with the direction of the arrow A illustrated in FIGS. 1 and 2.

The linear guide device 2 includes a track rail 21 to be laid on the storage top plate 103 of the storage cabinet 100, and a moving body 22 to be guided along the track rail 21 in the depth direction of the storage space 101. The track rail 21 is formed so as to be elongated from the opening portion 104 of the storage space 101 in the depth direction of the storage space 101. For example, two ball rolling surfaces 21*a* are respectively formed on both side surfaces of the track rail 21 along a longitudinal direction of the track rail 21. Further, mounting holes 21*b* for fixing the track rail 21 to the storage top plate 103 of the storage cabinet 100 are formed through the track rail 21 at predetermined intervals in the longitudinal direction of the track rail 21.

Figure 5:
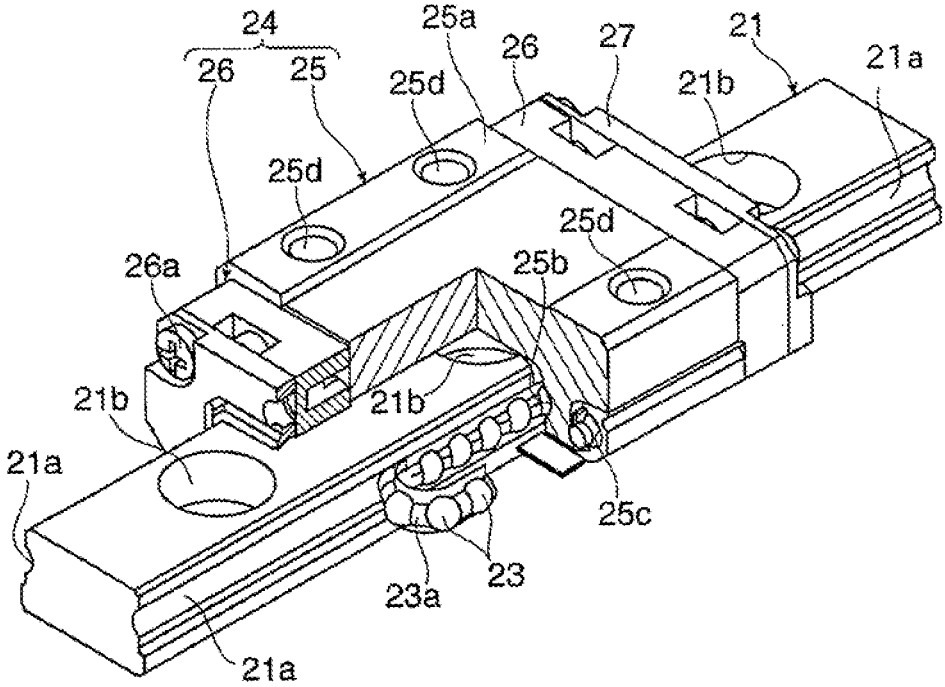
FIG. 5 is a perspective view illustrating a track member and a moving member included in the movable rack unit illustrated in FIG. 3.

On the other hand, the moving body 22 includes, for example, two moving members 24 to be assembled to the track rail 21, and a flat plate member 5 coupling the two moving members 24 to each other. FIG. 5 is a perspective view illustrating the details of the moving member 24 assembled to the track rail 21. The moving member 24 includes a block main body 25 that is assembled to the track rail 21 through intermediation of a large number of balls 23 and includes a mounting surface 25*a* for the plate member 5, a pair of lid members 26 fixed to both end surfaces of the block main body 25 in the moving direction thereof, and sealing members 27 for preventing foreign matters from entering inside the moving member 24 from a gap between the moving member 24 and the track rail 21. In the block main body 25, there are formed a load ball rolling surface 25*b* forming a ball rolling path together with the opposing ball rolling surface 21*a* of the track rail 21, and a ball return passage 25*c* for circulating the balls 23. Further, bolt holes 25*d* are formed in the mounting surface 25*a*. Fixation bolts are respectively screwed into the bolt holes 25*d* so that a bracket member to be described later is coupled to each moving member 24. Note that, in FIG. 5, for easy understanding of the internal structure of the moving member 24, parts of the block main body 25 and the lid member 26 are illustrated in a cut-out manner.

On the other hand, in each of the lid members 26, there is formed a direction changing path (not shown) for scooping the balls 23 rolling on the ball rolling surface 21*a* of the track rail 21 to feed the balls 23 to the ball return passage 25*c* of the block main body 25, while feeding the balls 23 rolling on the ball return passage 25*c* to the ball rolling surface 21*a*. The pair of lid members 26 is fixed to the block main body 25 with use of fixation bolts 26*a*, and thus the moving member 24 is provided with an endless circulation path for the balls 23, which includes the ball rolling path, the ball return passage 25*c*, and the direction changing path. The balls 23 circulate inside the endless circulation path provided in the moving member 24, and thus the moving member 24 reciprocates along the track rail 21.

The balls 23 are arrayed in one row at regular intervals on, for example, a flexible connector belt 23*a*, and are housed into the endless circulation path together with the connector belt 23*a*. The connector belt 23*a* is formed by injection molding of a synthetic resin. Note that, the balls 23 may be directly housed in the endless circulation path without using the connector belt 23*a*.

Figure 6:
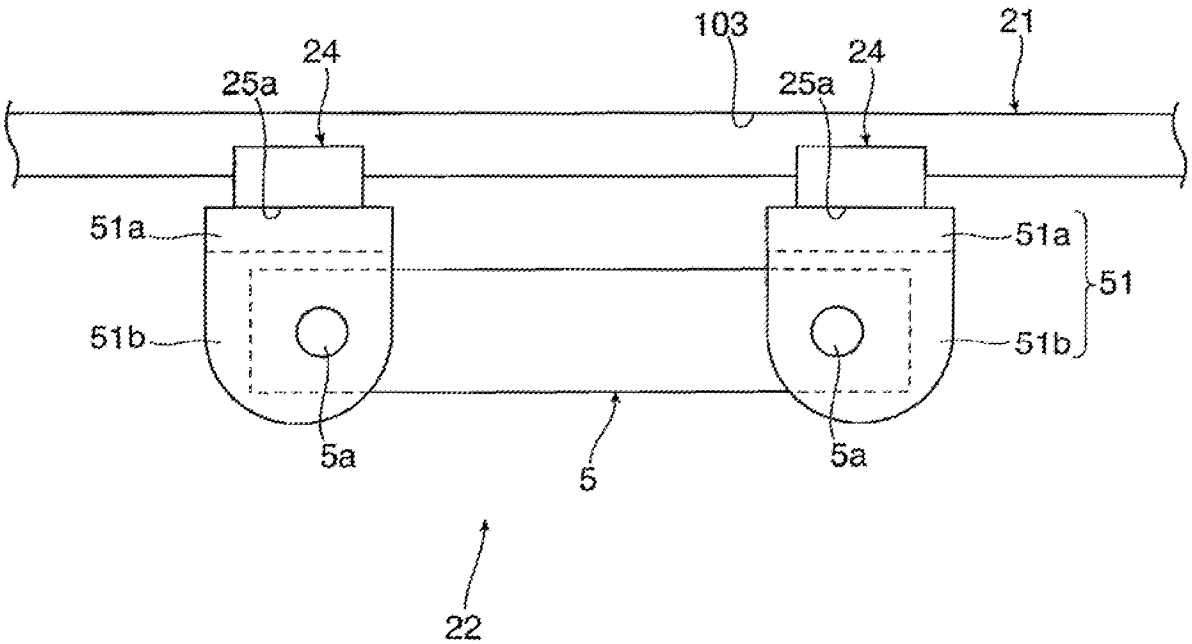
FIG. 6 is a side view of a moving body illustrated in FIG. 3.

Two moving members 24 configured as described above are assembled to the track rail 21. Further, those moving members 24 are coupled to each other by the plate member 5 to construct the moving body 22. FIG. 6 is a side view illustrating the moving body 22. A bracket member 51 for coupling the plate member 5 to each moving member 24 is fixed to the mounting surface 25*a* of each moving member 24 with fixation bolts. Each bracket member 51 includes an abutment piece 51*a* to be fixed to the mounting surface 25*a* of the block main body 25 and a plate fixation piece 51*b* to be coupled to the plate member 5. The plate fixation piece 51*b* is provided perpendicularly with respect to the abutment piece 51*a* so that the cross section becomes an L-shape (see FIG. 3). Each of both ends of the plate member 5 is directly fixed to each plate fixation piece 51*b* with a single fixation bolt 5*a*.

On the other hand, as illustrated in FIGS. 3 and 4, a rotary bearing 6 is fixed to the plate member 5 through intermediation of a bearing retaining member 61. The rotary bearing 6 rotatably supports a shaft member 31 fixed to the support arm 3 by a fixation nut 31*a*. That is, the support arm 3 is assembled to the moving body 22 through intermediation of the shaft member 31 so as to be rotatable by the rotary bearing 6.

The rotary bearing 6 includes an inner race member 62 that is brought into sliding contact with an outer peripheral surface of the shaft member 31, and an outer race member 63 assembled to the inner race member 62 through intermediation of a plurality of balls 64 and fixed to the bearing retaining member 61. Between the inner race member 62 and the outer race member 63, for example, two ball rows are provided. Further, the contact angle between each ball 64 and the inner race member 62 and the contact angle between each ball 64 and the outer race member 63 are set equal to each other, and the ball rows arranged between the inner race member 62 and the outer race member 63 can apply a radial load and an axial load to act on the shaft member 31. That is, the rotary bearing 6 has a configuration of a so-called double-row angular ball bearing.

The rotary bearing 6 configured as described above is fixed to the plate member 5 through intermediation of the bearing retaining member 61 as described above. Further, the rotary bearing 6 is arranged between the two moving members 24 arranged in the longitudinal direction of the track rail 21 (see FIG. 4). Then, the support arm 3 rotatably supported by the rotary bearing 6 through intermediation of the shaft member 31 is borne on the moving body 22 so as to be rotatable in the direction of an arrow D about the shaft member 31.

The support arm 3 that is rotatably assembled to the moving body 22 by the rotary bearing 6 includes a first arm member 32 fixed to the shaft member 31 by the fixation nut 31*a*, and a second arm member 33 fixed to the first arm member 32. The second arm member 33 is connected to the first arm member 32 within, for example, the same plane and in a direction that intersects with the longitudinal direction of the first arm member 32. The plurality of storage objects 102 such as coats can be arranged on the second arm member 33. Further, the second arm member 33 is provided with an operation lever (not shown) for taking in and out the storage object 102 with respect to the storage space 101.

On the other hand, the rotation guiding means 4 includes a guide groove 41 formed in the storage top plate 103 of the storage cabinet 100, and a cam member 42 that moves along the peripheral wall of the guide groove 41. The guide groove 41 is provided from the opening portion 104 of the storage space 101 in the depth direction of the storage space 101. The guide groove 41 includes a linear region 41*a* provided in parallel to the track rail 21, and a curved region 41*b* continuous to one end of the linear region 41*a*. The curved region 41*b* is formed into an arc shape with a constant curvature, and its axis center matches with the axis center of the rotary bearing 6. Further, the curved region 41*b* configured as described above is continuous to a terminal end portion of the linear region 41*a* provided on the opening portion 104 side of the storage space 101.

The cam member 42 includes a stud 43 formed into a circular shape in cross section, and a guide disk 44 that is fixed to one end of the stud 43 and moves inside the guide groove 41. The outer diameter of the guide disk 44 is set slightly smaller than the groove width of the guide groove 41. On the other hand, the stud 43 is retained by the first arm member 32 through intermediation of a stud coupling member 43*a*. The stud coupling member 43*a* is directly fixed to the first arm member 32 by fixation bolts 43*b*, while the stud coupling member 43*a* retains the stud 43 through intermediation of a bush member 43*c*. The bush member 43*c* is brought into sliding contact with an outer peripheral surface of the stud 43, and the cam member 42 including the stud 43 and the guide disk 44 rotates with respect to the stud coupling member 43*a*.

In the movable rack unit 1 of this embodiment configured as described above, as illustrated in FIG. 1, the moving body 22 including the plate member 5 and the two moving members 24 is guided, from a state in which the moving body 22 is located on the back side of the storage space 101, on the track rail 21 toward the opening portion 104 of the storage space 101 by the operation of the operation lever provided on the second arm member 33. At this time, the moving body 22 moves linearly along the track rail 21, and further the guide disk 44 constituting the cam member 42 rolls inside the linear region 41*a* of the guide groove 41. In this case, the outer diameter of the guide disk 44 is set slightly smaller than the groove width of the guide groove 41, and hence the movement of the guide disk 44 in the groove width direction of the guide groove 41 is restricted. Therefore, under the state in which the guide disk 44 rolls inside the linear region 41*a* of the guide groove 41, the rotational motion of the support arm 3 in the direction of the arrow D in FIG. 4 is restricted. Further, under this state, the storage object 102 is hung on the second arm member 33 so that the front side of the storage object 102 is directed toward the opening portion 104.

Further, when the moving body 22 is guided to the opening portion 104 of the storage space 101 by the operation of the operation lever provided on the second arm member 33, the cam member 42 rolling inside the linear region 41*a* of the guide groove 41 enters the curved region 41*b* of the guide groove 41, and thus the cam member 42 moves in a curved manner along the peripheral wall of the curved region 41*b*. In this case, the first arm member 32 constituting the support arm 3 is rotatably assembled to the moving body 22 through intermediation of the rotary bearing 6, and hence the support arm 3 moves, within a horizontal plane, rotationally in the direction of the arrow D illustrated in FIG. 4 along with the curve movement of the cam member 42 along the curved region 41*b* of the guide groove 41.

Figure 7:
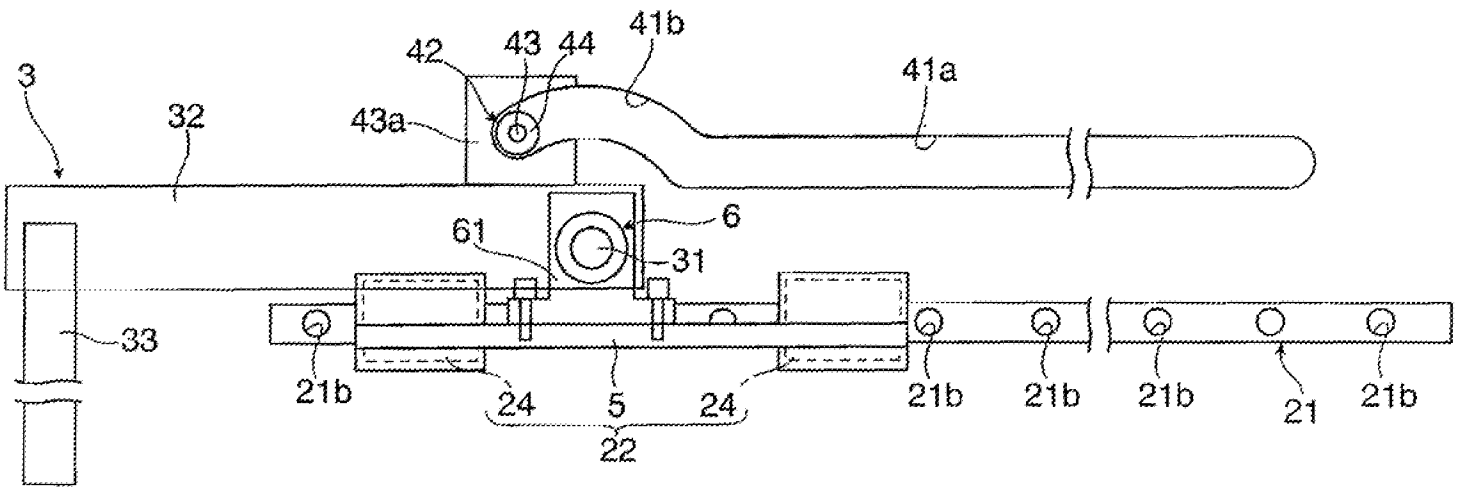
FIG. 7 is a schematic view illustrating the movable rack unit in a state where the moving body is guided to an opening portion of a storage space.

Simultaneously therewith, the attitude of all of the storage objects 102 hung on the support arm 3 is gradually changed, and as illustrated in FIG. 7, when the cam member 42 is guided to the terminal end portion of the curved region 41*b* of the guide groove 41, the storage object 102 is pulled out from the storage space 101 under a state in which the attitude of the storage object 102 is changed by about 90°, for example (see FIG. 2).

According to the movable rack unit 1 of this embodiment configured as described above, when, of the plurality of storage objects arranged on the movable body, the storage object stored on the rear side in the depth direction of the movable body is taken out, it is unnecessary to pull out the entire movable body from the storage unit main body, and by merely guiding the moving body 22 to the position of the opening portion 104 of the storage space 101 by the operation of the operation lever provided on the support arm 3, the storage object 102 stored on the rear side in the depth direction of the movable body can be easily pulled out from the storage space 101.

Further, in the movable rack unit 1 according to this embodiment, under a state in which the moving body 22 is guided to the opening portion 104 of the storage space 101, the storage object 102 hung on the support arm 3 is pulled out from the storage space 101 while the attitude of the storage object 102 is changed by 90° at the maximum. Therefore, even when, for example, the movable rack unit 1 according to this embodiment is applied to transportation facilities having a limited storage space, such as an aircraft, and the opening portion 104 of the storage space 101 faces a passage having a narrow widthwise length, the storage object 102 can be taken in and out with respect to the storage space 101 at the passage.

Further, according to the movable rack unit 1 of this embodiment, under a state in which the moving body 22 is guided to the opening portion 104 of the storage space 101, the attitude of the storage object 102 hung on the support arm 3 changes by 90° at the maximum. Therefore, when, of the plurality of storage objects arranged on the movable body, the storage object stored on the rear side in the depth direction of the movable body is taken out, even if the storage object 102 is pulled out from the storage space 101, the storage object 102 does not become a barrier for the passengers and the like that use the passage facing the opening portion 104.

Note that, in the movable rack unit 1 according to this embodiment, the moving body 22 constituting the linear guide device 2 is configured so that the plate member 5 is fixed to the two moving members 24 through intermediation of the bracket members 51, but the configuration of the bracket members 51 may be omitted, and both ends of the plate member 5 may be directly fixed to the mounting surfaces 25*a* of the respective moving members 24.

Further, in the movable rack unit 1 according to this embodiment, the moving body 22 includes the two moving members 24 and the plate member 5 coupling those moving members 24. Further, the support arm 3 is rotatably borne on the plate member 5 through intermediation of the rotary bearing 6. However, the moving body 22 may include a single moving member 24, and the rotary bearing 6 may be provided to this single moving member 24 so as to support the support arm 3 by this rotary bearing 6. Alternatively, the rotary bearing 6 and the support arm 3 may be supported with respect to the single moving member 24 through intermediation of a bracket member or the like.

Further, in the movable rack unit 1 according to this embodiment, the moving body 22 includes the two moving members 24, and those two moving members 24 are assembled to the track rail 21. However, the number of the moving members 24 to be assembled to the track rail 21 may be changed as appropriate in accordance with the load ability that is required for the movable rack unit 1.

Further, in the movable rack unit 1 according to this embodiment, description is made of a configuration example of the guide means using balls as rolling elements, but rollers may be used as the rolling elements.

Further, in the movable rack unit 1 according to this embodiment, a single moving body 22 is assembled to a single track rail 21, and the moving body 22 is guided toward the opening portion 104 provided in the storage space 101. However, for example, the movable rack unit of the present invention is applicable to a storage space 101 having two opening portions 104 directed in directions opposite to each other. In this case, two moving bodies 22 may be assembled to a single track rail 21, and further the support arm 3 may be rotatably borne on each moving body 22. Thus, the respective moving bodies 22 may be guided toward the respective opening portions 104.

Further, in the movable rack unit 1 according to this embodiment, the operator such as the passenger operates the operation lever provided to the second arm member 33 to guide the moving body 22 toward the opening portion 104. However, the guiding operation of the moving body 22 may be automated through remote control, and the guiding operation may be performed in response to, for example, the energization to a solenoid.

The invention claimed is:

1. A movable rack unit for taking in and out a storage object with respect to a storage space, the movable rack unit comprising:

guide means comprising:

a track member linearly laid inside the storage space and along a depth direction of the storage space; and a moving body assembled to the track member so as to be movable along the track member;

a support member for supporting the storage object, the support member being rotatably borne on the moving body; and a rotation guiding means for changing an attitude of the support member in accordance with a moving position of the moving body, and under a state in which the moving body is located at an end portion of the track member on an opening portion side of the storage space, setting the support member outside the storage space;

wherein the rotation guide means comprises:

a guide groove comprising:

a linear region provided in parallel to the track member; and a curved region provided continuous to the linear region on the opening portion side of the storage space and is formed into an arc shape so as to cause the support member to rotate within a horizontal plane; and a cam member that moves along and inside the guide groove and is fixed to the support member.

2. The movable rack unit according to claim 1, wherein the track member is provided with a rolling element having a rolling surface on each of both side surfaces along the longitudinal direction of the track member, and wherein the moving body of the guide means comprises a moving member to be assembled to the track member through intermediation of a large number of rolling elements that roll on the rolling element rolling surface of the track member.

3. The movable rack unit according to claim 1, wherein the support member comprises:

a first arm member rotatably borne on the moving body through intermediation of a rotary bearing; and a second arm member that is connected to the first arm member in a direction that intersects with a longitudinal direction of the first arm member, the second arm member being configured to support the storage object.

* * * * *